United States Patent [19]

O'Brian et al.

[11] 4,085,762

[45] Apr. 25, 1978

[54] FOLDING, RIGID, TENT-LIKE STRUCTURE

[76] Inventors: Edward D. O'Brian, 910 Iroquois, Anaheim, Calif. 92801; William M. Plachy, 3353 San Marcos Blvd., Los Angeles, Calif. 92069

[21] Appl. No.: 786,824

[22] Filed: Apr. 12, 1977

[51] Int. Cl.[2] ..... A45F 1/16

[52] U.S. Cl. ..... 135/4 R; 5/99 C; 40/610; 46/12; 46/21; 119/19; 182/153; 312/244; 312/258; 312/263

[58] Field of Search ..... 108/115; 119/19; 40/125 H; 46/12, 21; 116/63 D; 211/198, 199; 312/244, 258, 263, 264; 182/153; 5/99 C

[56] References Cited

U.S. PATENT DOCUMENTS

| | | | |
|---|---|---|---|
| 25,039 | 8/1859 | Parkhurst | 182/153 |
| 109,166 | 11/1870 | Achenbach | 119/19 |
| 1,007,956 | 11/1911 | Maurer | 119/19 |
| 1,107,871 | 8/1914 | Alkire et al. | 119/19 |
| 1,284,624 | 11/1918 | Ehrenberg | 40/125 H |
| 1,446,296 | 2/1923 | Irvin | 135/4 R |
| 1,556,624 | 10/1925 | Pavenick | 182/153 |
| 2,043,072 | 6/1936 | Schmitt et al. | 5/99 C |
| 2,173,639 | 9/1939 | Swanson | 5/99 C |
| 2,650,375 | 9/1953 | Serrell | 5/99 C |
| 2,702,727 | 2/1955 | Sweet | 182/153 |
| 3,807,104 | 4/1974 | Webster | 52/71 |

*Primary Examiner*—Werner H. Schroeder
*Assistant Examiner*—Conrad L. Berman
*Attorney, Agent, or Firm*—Edward D. O'Brian

[57] ABSTRACT

A folding, rigid tent-like structure useful for a variety of play purposes can be constructed so as to utilize a pair of sides. These sides have top edges which are preferably connected by a connector and appropriate hinges so that the sides may be pivoted relative to one another. A pair of bottom walls are located between these sides adjacent to the bottom edges of these sides. The bottom walls have pivotally connecting adjacent edges and side edges which are pivotally connected to the sides. At least one folding link structure is secured to the sides beneath the bottom wall. This folding link structure serves to support the bottom walls against sagging. The tent-like structure may be folded to a flat position by concurrently folding the link structure between the sides and folding the bottom walls so that they are adjacent to one another between the sides as the sides themselves are pivoted so as to be adjacent to one another.

5 Claims, 5 Drawing Figures

FOLDING, RIGID, TENT-LIKE STRUCTURE

BACKGROUND OF THE INVENTION

The invention set forth in this specification pertains to a folding, rigid, tent-like structure useful for play purposes.

A wide variety of different types of structures have been developed for use by children in connection with play activities. In general, those structures which are of such a character as to be capable of being utilized by children in a variety of different manners are considered to be highly desirable. This is particularly the case where such structures are constructed so that they can be utilized in accordance with a child's imagination as a wide variety of different simulated adult objects such as a tent, a hill, a fort, and so on.

Although many different types of play structures capable of being utilized in a wide variety of different ways have been developed and used it is considered that there is an existing need for new and improved play structures which can be utilized in a variety of different ways. It is also considered that there is a need for play structures which can be easily and conveniently folded so as to be stored when not in use. To a large extent this is related to the fact that many homes and child care facilities where play equipment is needed do not have adequate room so as to utilize non-folding or rigid structures which are intended to be left in place during periods when they are not utilized for play purposes.

SUMMARY OF THE INVENTION

A basic objective of the present invention is to provide new and improved play structures which can be utilized in a number of different ways and which are of such a character that they can be easily folded for storage when they are not to be used and which can be just as easily unfolded for use. Other objectives of the invention are to provide new and improved play structures which may be easily and conveniently constructed at a comparatively nominal cost, which are advantageous from a commercial standpoint in that they can be shipped in a very compact form, in that they occupy comparatively little storage space, and in that they can be utilized in a wide variety of diverse ways by children and also be easily and conveniently folded and unfolded by an adult.

In accordance with this invention these various objectives are achieved by providing a folding, rigid, tent-like structure useful for play purposes which comprises: a pair of rigid sides, each of these sides having a top edge and a bottom edge, connecting means pivotally attached to said top edges of the sides for pivotally connecting the sides so that they may be manipulated relative to one another between a folded position in which the sides are adjacent to one another and an expanded position in which the sides are at an angle to one another, a pair of bottom walls located between the sides, each of the bottom walls having a side edge located adjacent to a bottom edge of one of the sides and a center edge, these center edges being located adjacent to one another, a side edge hinge means connecting the side edge of each of the bottom walls to the adjacent of the sides and a center edge hinge means connecting the center edges to one another, the side and center edge hinge means being located so as to permit the bottom walls to be pivoted so as to lie adjacent to one another between the sides when the sides are in the folded position.

BRIEF DESCRIPTION OF THE DRAWING

The invention is best more fully explained with reference to the accompanying drawing in which.

Figure 1:
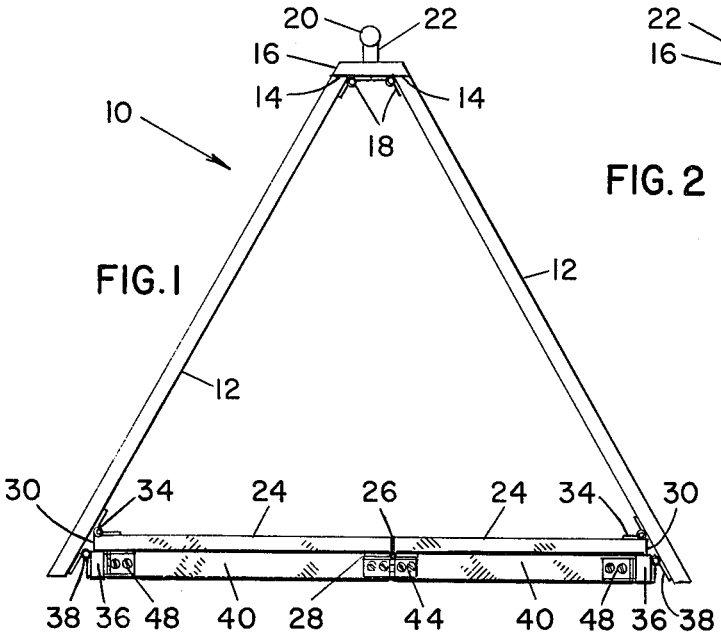
FIG. 1 is a front elevational view of a presently preferred embodiment of a folding, rigid, tent-like structure useful for play purposes in accordance with this invention in an unfolded or expanded configuration.
Figure 2:
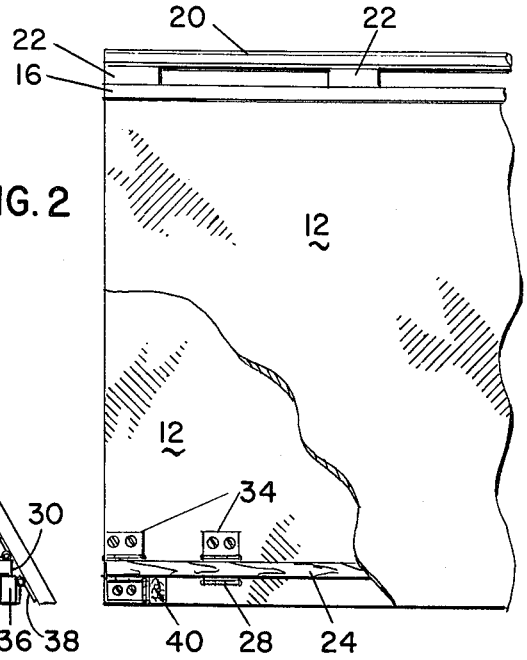
FIG. 2 is a side elevational view of this structure as shown in FIG. 1.
Figure 3:
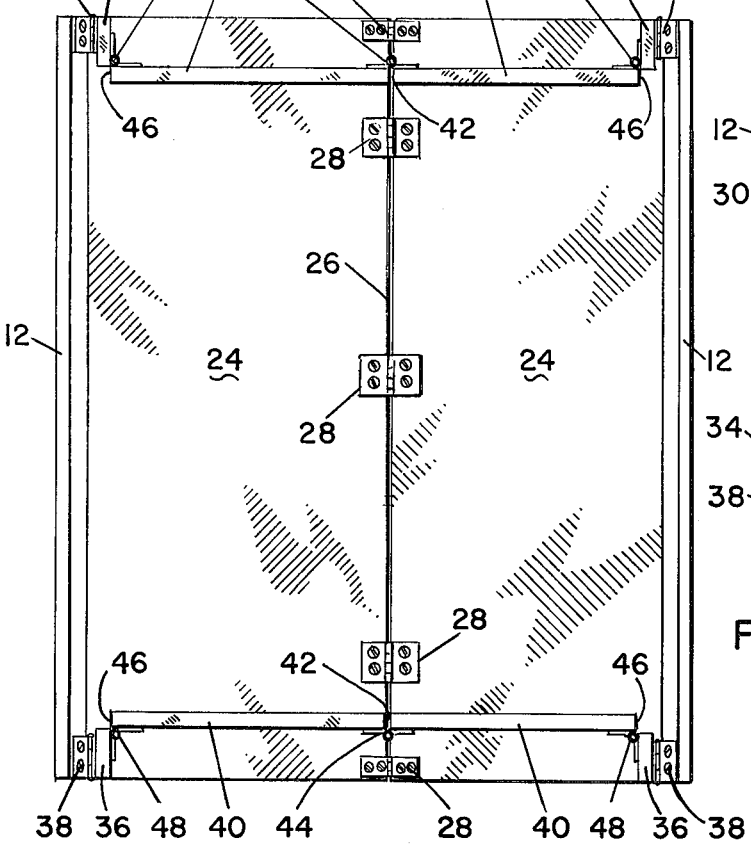
FIG. 3 is a bottom plan view of this structure as shown in FIG. 1.
Figure 5:
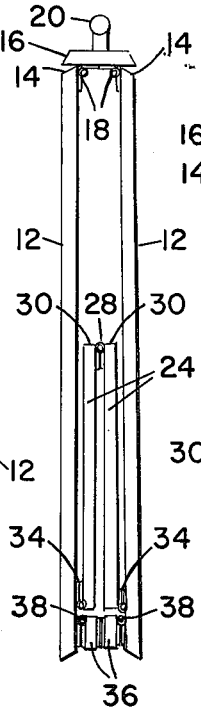
FIG. 5 is a bottom plan view of the structure shown in the preceding figures in a folded or collapsed configuration.

The structure illustrated in the drawing employs or embodies the operational principles or concepts set forth in the appended claims. These principles or concepts can be utilized within various somewhat differently appearing and somewhat differently constructed rigid, tent-like structures through the use or exercise of routine engineering skill. Under the circumstances the invention is not to be considered as being limited to the precise structure illustrated in the drawing.

DETAILED DESCRIPTION

Figure 4:
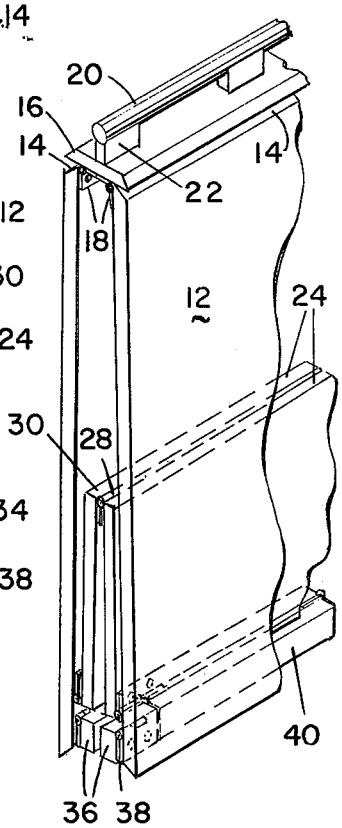
FIG. 4 is an isometric view showing this structure in a folded or collapsed position for shipment or storing purposes.

In the drawing there is shown a folding, rigid, tent-like structure 10 in accordance with this invention which is constructed so as to utilize a pair of rigid sides 12. These sides 12 have beveled top edges 14 which are adapted to abut against a narrow, elongated connecting wall 16 when the structure 10 is in an unfolded position or configuration. Two sets of connecting hinges 18 are utilized to connect the connecting wall 16 to the sides 12 in such a manner that these sides 12 are capable of being manipulated or folded between the positions indicated in FIGS. 1 and 4 of the drawing. Preferably the wall 16 carries an exposed, rounded rail 20 which is spaced from the wall 16 by mounting members 22 located along the length of the rail 20. This rail 20 is intended to be utilized as a handle in carrying the structure 10 from one location to another. It is also intended to make it virtually impossible for a child to walk along the connecting wall 16.

The structure 10 also includes a pair of bottom walls 24 which have adjacent center edges 26 connected by center edge hinges 28. These bottom walls 24 also have side edges 30 which are located adjacent to bottom edges 32 of the sides 12. These side edges 30 are, however, spaced from the bottom edges 32; they are parallel to these bottom edges 32. The side edges 30 are connected to the sides 12 by means of side edge hinges 34. The hinges 28 and 34 are parallel to one another and to the hinges 18 and are located so that the center edges 28 will pivot upwardly generally between the sides 12 as the sides 12 are pivoted toward one another.

The structure 10 also includes at least one and preferably two folding link structures (not separately numbered), each of which includes two attachment members 36. Each member 36 is mounted by means of a hinge 38 on a side 12 generally beneath the side edges 30. These attachment members 36 are secured by the hinges 38 so as to pivot about axes (not separately numbered) which are parallel to the axes of the hinges 18, 28 and 34 previously described. A set (not numbered) of two links 40 is utilized between the attachment members 36. These links 40 have adjacent edges 42 which are secured together by adjacent edge hinges 44 and terminal ends 46 secured to the members 36 by terminal end hinges 48. The hinges 44 and 48 have parallel, vertically directed axes (not shown).

This structure permits the links 40 to fold with respect to one another so as to extend along and generally parallel to the bottom edges 32 as the structure 10 is manipulated to a folded position. The links 40 are preferably dimensioned so as to be capable of resting on an appropriate supporting surface (not shown) which is also utilized to support the bottom edges 32 of the sides 12. They are also preferably dimensioned so as to support the bottom wall 24 so that these walls 24 are coplanar when the structure 10 is in the unfolded or expanded position.

By supporting the walls 24 in this manner they prevent these walls 24 from sagging. Further, they space these bottom walls 24 above such a supporting surface to a sufficient extent that these bottom walls 24 are not apt to become damp even when the structure 10 is utilized on damp ground or damp grass. It will also be realized that both the links 40 and the bottom walls 24 serve to limit the amount that the sides 12 can be pivoted about the connecting wall 16 away from one another.

It is believed that the manner in which the structure 10 may be manipulated between folded and unfolded positions will be apparent from a consideration of the preceding. Such manipulation involves the folding of the sides 12, the bottom walls 24 and the links 40 in a concurrent manner. The structure 10 is considered to be desirable in that it can be folded and unfolded without any part of this structure having to be fastened or unfastened. Further, the complete structure 10 is of such a nature that while it can be manipulated by an adult between folded and unfolded configurations without difficulty, it is comparatively difficult for children to fold it when it is in an unfolded position. This is considered to be desirable for safety reasons.

The structure 10 can be utilized for a wide variety of different play purposes. It can be employed as a tent; it can be employed as a playhouse; it is useful as a so-called "hidey-hole". The sides 12 of the structure 10 can be waxed so as to be useful as slides. Toy cars and similar vehicles can be allowed to roll down the sides 12. It is considered that the number of uses that a child can make of a structure such as the structure 10 is primarily limited only by the child's imagination.

The particular structure 10 illustrated is of a symmetrical character employing identical sides 12 and identical bottom walls 24. A symmetrical structure of this type is considered desirable in minimizing the volume occupied in a folded configuration. It is noted, however, that structures corresponding to the structure 10 can be manufactured having one of the sides 12 longer than the other. Such structures will fold satisfactorily if one of the bottom walls 24 is of smaller dimension than the other of the bottom walls 24 in accordance with the obvious mathematical relationship. Such asymmetrical structures are not considered as desirable as the structure 10 for certain play purposes inasmuch as their interior volume is not as effectively utilized as in a symmetrical structure as shown. It is noted that the connecting wall 16 in the structure 10 overlies the adjacent edges (not separately numbered) of the sides 12 when the structure 10 is unfolded. This is considered to minimize the possibilities of hazard during play and to tend to make the structure 10 somewhat weather tight or resistant.

We claim:

1. A folding, rigid, tent-like structure useful for play purposes which comprises:

a pair of rigid sides, each of said sides having a top edge and a bottom edge, connecting means attached to said top edges of said sides for pivotally connecting said sides so that they may be pivoted relative to one another between a folded position in which said sides are adjacent to one another and an expanded position in which said sides are at an angle to one another, a pair of bottom walls located between said sides, each of said bottom walls having a side edge located adjacent to a bottom edge of one of said sides and center edges, said center edges being located adjacent to one another, a side edge hinge means connecting the side edge of each of said bottom walls to the adjacent of said sides, a center edge hinge means connecting said center edges of said bottom walls to one another, said side edge and said center edge hinge means being located so as to permit said bottom walls to be pivoted so as to lie adjacent to one another between said sides when said sides are in said folded position, folding link means attached to said sides and extending beneath said bottom walls for limiting the amount said sides can pivot relative to said connecting means away from one another and for supporting said bottom walls when said sides are in said expanded position so that said bottom walls are coplanar.

2. A folding structure as claimed in claim 1 wherein:

said link means comprise attachment members pivotally mounted on said sides and two link members, said link members having adjacent edges pivotally connected together, each of said link members having an end pivotally connected to one of said attachment members, said link members fitting beneath said bottom walls when said structure is in said expanded position.

3. A folding structure as claimed in claim 1 wherein:

said connecting means comprises an elongated connecting wall and two sets of connecting hinges, one of said sets of connecting hinges pivotally connecting one of said sides of said connecting wall, the other of said sets of connecting hinges pivotally connecting the other of said sides to said connecting wall, and said link means comprise attachment members pivotally mounted on said sides and two link members, said link members having adjacent edges pivotally connected together, each of said link members having an end pivotally connected to one of said attachment members, said link members fitting beneath said bottom walls when said structure is in said expanded position, means located on said connecting wall for inhibiting an individual from walking along said connecting means and for use as a handle in carrying said structure.

4. A folding structure as claimed in claim 1 wherein: said connecting means comprises an elongated connecting wall and two sets of connecting hinges, one of said sets of connecting hinges pivotally connecting one of said sides of said connecting wall, the other of said sets of connecting hinges pivotally connecting the other of said sides to said connecting wall.

5. A folding structure as claimed in claim 4 including: means located on said connecting wall for inhibiting an individual from walking along said connecting means and for use as a handle in carrying said structure.

* * * * *